United States Patent [19]

Corsetti

[11] Patent Number: 4,827,556

[45] Date of Patent: May 9, 1989

[54] CEILING FAN BLADE CLEANING DEVICES

[76] Inventor: John A. Corsetti, 833 SW. Bayshore Blvd., Port St. Lucie, Fla. 33452

[21] Appl. No.: 208,768

[22] Filed: Jun. 20, 1988

[51] Int. Cl.[4] ..... A47L 25/00

[52] U.S. Cl. ..... 15/244.1; 15/210 R

[58] Field of Search ..... 15/160, 209 R, 210 R, 15/210 A, 210 B, 236.09, 244.1, 244.2, 244.3, 244.4; D32/51

[56] References Cited

U.S. PATENT DOCUMENTS

| | | | |
|---|---|---|---|
| D. 296,022 | 5/1988 | Restivo | D32/51 |
| 1,437,145 | 11/1922 | Johnson | 15/210 R |
| 1,922,450 | 8/1933 | O'Brien | 15/244.1 |

*Primary Examiner*—Edward L. Roberts

*Attorney, Agent, or Firm*—Carroll F. Palmer

[57] ABSTRACT

A ceiling fan blade cleaning device includes a fork member and a separable cleaner member. The fork member has a tubular handle by which the user holds the device for cleaning purposes and a pair of shafts extend from the distal end of the handle shaped to give the fork member a Y-shape. The cleaner member is formed of fibrous web material and has a rectangular central portion formed of a pair of spaced apart rectangular webs presenting an opening into which a ceiling fan blade may extend for simultaneous cleaning of its upper and lower surfaces. The side portions of the cleaner member have elongated channels into which the distal ends of the shafts extend to support the cleaner member on the fork member. Several embodiments of the devices are disclosed.

5 Claims, 1 Drawing Sheet

CEILING FAN BLADE CLEANING DEVICES

BACKGROUND OF THE INVENTION

1. Field of the Invention

This application relates to devices for cleaning the blades of ceiling fans. More particularly, it concerns such blade cleaners that can be used by a person standing on the floor beneath the fan to simultaneously clean the top and bottom surfaces of a fan blade with a single movement of the cleaning device.

2. Description of the Prior Art

Ceiling type fans are extensively used in dwellings, offices and many other types of buildings to circulate air and thereby reduce the cost of heating during cold weather and air-conditioning during hot weather. The blades of such fans, particularly on the top surfaces, become encrusted with a layer of dust that clings tenacously to the blade surface and must be removed from time to time to maintain full effective operation of the ceiling fan.

In a conventional method of cleaning ceiling fans, a person will stand on a ladder or stool so the blades can be reached and then cleaned with a cloth or brush. Because such cleaning operations are so arduous to perform, a majority of ceiling fan blades remain totally uncleaned or are not cleaned nearly as often as needed.

In another method used to clean ceiling fans, the extension wand and hose of a vacuum cleaner is used to remove dust from the blades. This method usually fails to do a satisfactory job because of blade movement and the inability of the wand to be positioned for correct cleaning.

In view of the deficiencies of typical methods as noted above for cleaning ceiling fan blades a need exists for new, improved devices for use in performing such cleaning operations. This invention provides a novel form of the needed cleaning devices.

It should be recognized that it is known to supply cleaning or polishing implements with handles or like extensions in order to permit a user to reach items to be cleaned that are otherwise situated out of reach of the user of the implement (see U.S. Pat. No. 4,375,115). Also, it is known to construct hand held cleaning implements so that a plurality of surfaces can be cleaned with a single movement of the implement (see U.S. Pat. Nos. 4,435,874 & 4,458,375). The present invention uses these known concepts to provide novel forms of ceiling fans cleaning devices that render such task less arduous the convention cleaning methods and with improved efficiency.

OBJECTS

A principal object of this invention it to provide new, improved forms of devices for use in the cleaning of the blades of ceiling fans. Further objects include the provision of:

1. Ceiling fan blade cleaning devices that do not require the user to employ a ladder, stool or the like to perform a cleaning operation.

2. Such cleaning devices which permit both surfaces of the fan blades to be simultaneously cleaned.

3. Such cleaning devices that include means to assist the user to quickly install the device into cleaning position on a fan blade.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of ceiling fan blade cleaning devices that basically comprise a fork member and a cleaner member.

The fork member has a tubular handle with a proximal end by which the user holds the device for cleaning purposes and a distal end. A pair of shafts, each having a distal end and a proximal end, are carried upon the distal end of the handle and these shafts are shaped to separate from one another as they extend distally of the handle to give the fork member a Y-shape.

The cleaner member is formed of fibrous web material and has a rectangular central portion and a pair of paralll side portions with the central portion being defined by a pair of spaced apart rectangular webs presenting an opening into which a ceiling fan blade may extend for simultaneous cleaning of its upper and lower surfaces, while the side portions have elongated channels into which the distal ends of the shafts extend to support the cleaner member of the device on the fork member.

The distal ends of the shafts extend a an angle relative to their respective proximal ends so the cleaner member installed on the device lies in a plane angled with respect to the longitudinal axis of the handle.

One of the rectangular webs of the central portion of the cleaner member is wider than the other rectangular web and this forms a means to assist the user of the device to position the cleaner member onto the end of a fan blade as will be apparent in the description of the drawings.

In preferred embodiments, the cleaner member is formed of a pair of rectanglar synthetic sponge sheets double stiched at the sides to create the elongated channels into which the curved shafts fit to hold the cleaner member on the fork member.

In another preferred embodiment, the cleaner member is formed of a pair of rectanglar synthetic sponge sheets defined by a distal edge, a proximal edge parallel to the distal edge, plus a pair of parallel sides normal to the edges and the sides of the sheets are stitched to a fabric stip to form the elongated channels on the sides of the cleaner member.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
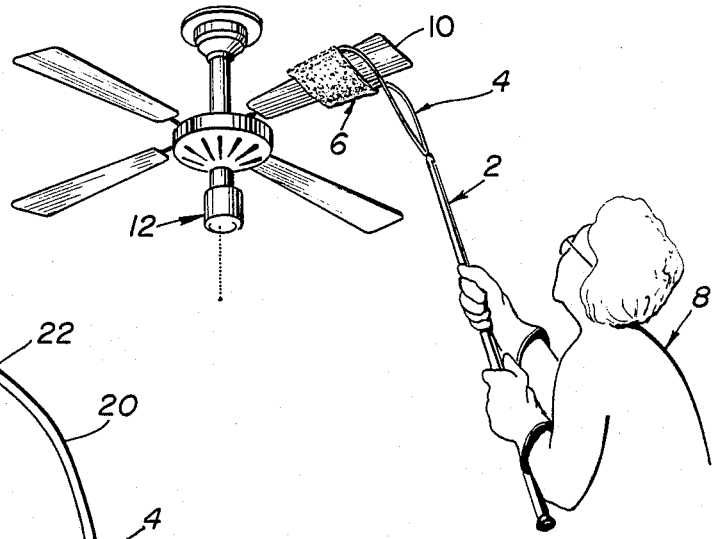
FIG. 1 is a perspective view of ceiling fan being used to clean a ceiling fan in accordance with the invention.
Figure 2:
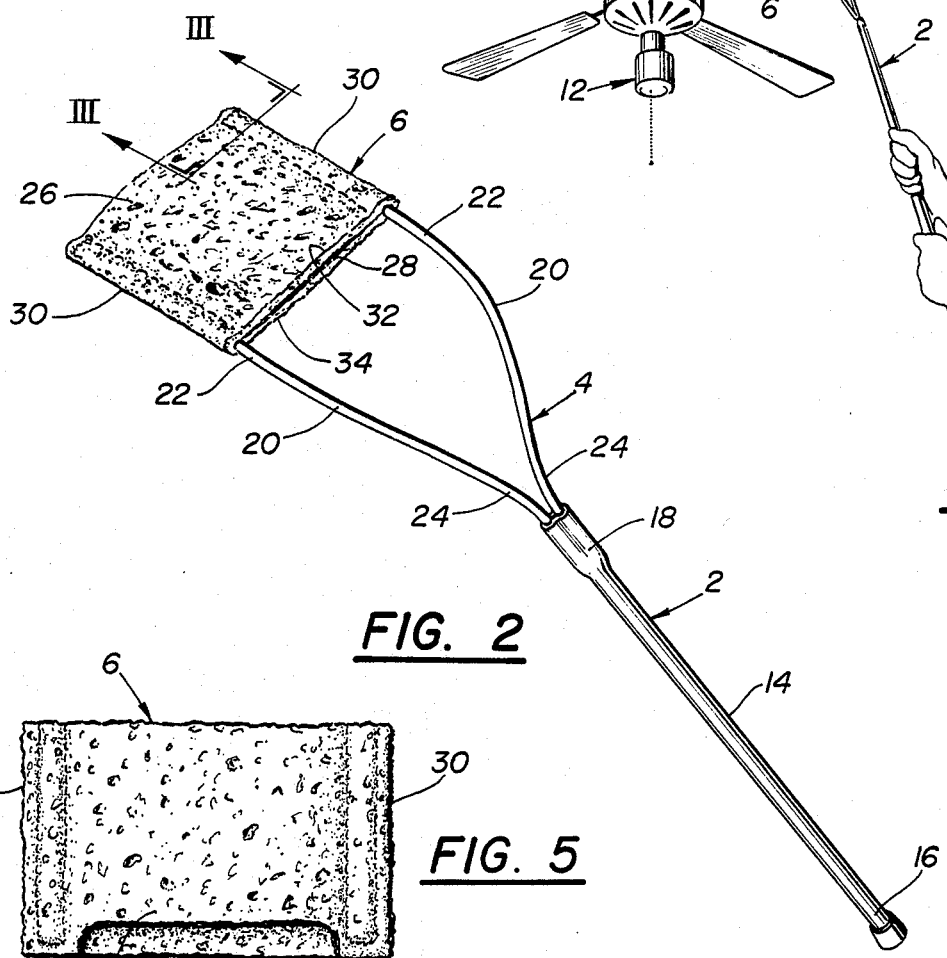
FIG. 2 is perspective view of a ceiling fan blade cleaner device constructed in accordance with the invention.

A ceiling fan blade cleaning device 2 of the invention comprises a fork member 4 and a cleaner member 6 that may be manipulated by a user 8 to clean the blades 10 of a ceiling fan 12.

The fork member 4 has a tubular handle 14 with a proximal end 16 by which the user 8 holds the device 2 for cleaning purposes and a distal end 18. A pair of shafts 20, each having a distal end 22 and a proximal end 24, are carried upon the distal end 18 of the handle 14 and these shafts are shaped to separate from one another as they extend distally of the handle 14 to give the fork member a Y-shape.

The cleaner member 6 is formed of fibrous web material 26, synthetic sponge sheets, and has a rectangular central portion 28 and a pair of parallel side portions 30 with the central portion 28 being defined by a pair of spaced apart rectangular webs 32 & 34 presenting an opening 36 into which a ceiling fan blade may extend for simultaneous cleaning of its upper and lower surfaces.

The side portions have elongated channels 38 into which the distal ends 22 of the shafts 20 extend to support the cleaner member 6 on the fork member 4.

The distal ends 22 of the shafts 20 extend at an angle relative to their respective proximal ends 24 so the cleaner member 6 installed on the device 2 lies in a plane angled with respect to the longitudinal axis of the handle 14.

Figure 5:
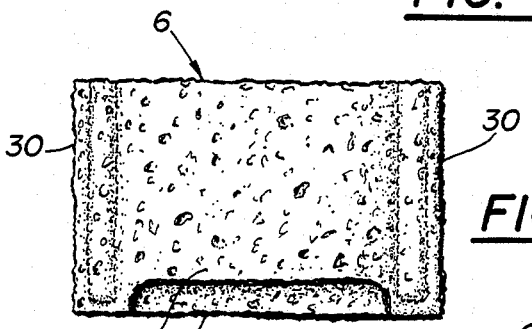
FIG. 5 is a plan view of a preferred embodiment of a cleaner member of the devices of the invention.
Figure 3:
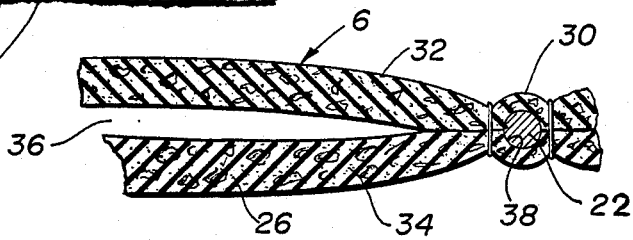
FIG. 3 is a sectional view taken on the line III—III of FIG. 2.
Figure 4:
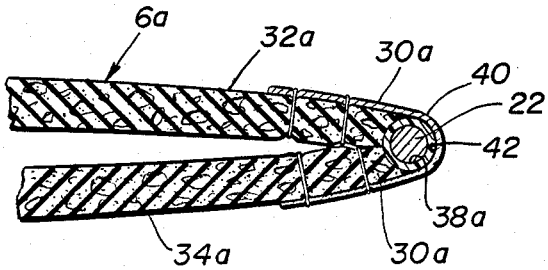
FIG. 4 is a sectional view similar to FIG. 3 of another embodiment of a cleaner device of the invention.

As seen in FIG. 5, the top rectangular web 32 of the central portion 28 of the cleaner member 6 is wider than the lower rectangular web 34 and this forms a means to assist the user of the device to position the cleaner member onto the end of a fan blade 10 since the leading edge of web 32 is not hidden from view of the user 8 as the device 2 is moved toward the blade 10 in applying the cleaner member 6 to the blade 10.

In a first embodiment, the cleaner member 6 is formed of a pair of rectanglar synthetic sponge sheets 32 & 34 double stiched at the sides 30 to create the elongated channels 38 into which the curved shafts 20 fit to hold the cleaner member 6 on the fork member 4.

In second embodiment, the cleaner member **6*a* is formed of a pair of rectanglar synthetic sponge sheets 32*a* & 34*a* defined by a distal edge, a proximal edge parallel to the distal edge, plus a pair of parallel sides 30*a* normal to the edges and the sides of the sheets 32*a* & 34*a* are stitched to a fabric stipe 40 around a section of flexible tubing 42 to form the elongated channels 38*a* on the sides 30*a* of the cleaner member 6*a***.

The emvodiments of the invention in which an exclusive property or privilege is claimed are defined as follows:

1. A ceiling fan blade cleaning device comprising:
a fork member and a cleaner member,
said fork member having
a tubular handle with a proximal end by which the user holds said device for cleaning purposes and a distal end, and
a pair of shafts each having a distal end and a proximal end carried upon said distal end of said handle, said shafts being shaped to separate from one another as they extend distally of said handle to give said fork member a Y-shape, and
said cleaner member being formed of fibrous web material and having a rectangular central portion and a pair of parallel side portions,
said central portion being defined by a pair of spaced apart rectangular webs presenting an opening into which a ceiling fan blade may extend for simultaneous cleaning of its upper and lower surfaces, and
said side portions having elongated channels therein into which said distal ends of said shafts extend to thereby support said cleaner portion of said device on said fork portion.

2. The cleaning device of claim 1 wherein said distal ends of said shafts extend at an angle relative to their respective proximal ends whereby said cleaner member installed on said device lies in a plane angled with respect to the longitudinal axis of said handle.

3. The cleaning device of claim 1 wherein one of said rectangular webs of said central portion of said cleaner member is wider than said other rectangular web forming a means to assist the user of said device to position said cleaner member onto the end of a fan blade.

4. The cleaning device of claim 1 wherein said cleaner member is formed of a pair of rectanglar synthetic sponge sheet double stiched at the sides thereof to create said elongated channels.

5. The cleaning device of claim 1 wherein said cleaner member is formed of a pair of rectanglar synthetic sponge sheets defined by a distal edge, a proximal edge parallel to said distal edge, and a pair of parallel sides normal to said edges, said sides of said sheets being stitched to a fabric stip to form said elongated channels on the sides of said cleaner member.

* * * * *